US005358138A

United States Patent [19]

Karwoski

[11] Patent Number: 5,358,138

[45] Date of Patent: * Oct. 25, 1994

[54] TRASH CONTAINER

[76] Inventor: Alexander Karwoski, 53 Francis Meyers Rd., New Britain, Pa. 18901

[ * ] Notice: The portion of the term of this patent subsequent to Mar. 22, 2011 has been disclaimed.

[21] Appl. No.: 142,961

[22] Filed: Oct. 29, 1993

Related U.S. Application Data

[63] Continuation-in-part of Ser. No. 38,825, Mar. 29, 1993, Pat. No. 5,295,606.

[51] Int. Cl.[5] ..... B65D 7/04

[52] U.S. Cl. ..... 220/403; 220/404; 220/308

[58] Field of Search ..... 220/908, 404, 403

[56] References Cited

U.S. PATENT DOCUMENTS

| | | | |
|---|---|---|---|
| 3,997,072 | 12/1976 | Guth | 220/908 |
| 4,167,271 | 9/1979 | Jorgensen | 220/908 |
| 4,280,676 | 7/1981 | Betts | 220/908 |
| 4,281,813 | 8/1981 | Garrity | 220/908 |
| 4,331,341 | 5/1982 | McKeonn | 220/908 |
| 4,643,380 | 2/1987 | Copeland | 220/908 |
| 4,951,831 | 8/1990 | Roesch et al. | 220/908 |
| 4,991,500 | 2/1991 | Knapp | 220/908 |

*Primary Examiner*—Joseph Man-Fu Moy
*Attorney, Agent, or Firm*—Joseph W. Molasky & Associates

[57] ABSTRACT

A trash container having a drum on a dolly. The drum, which is open at the top and bottom and includes openings along its surface, is positioned upon the dolly for easy moving and positioning. A trash bag liner is located within the drum such that when the liner is filled, the dolly is rolled to a disposal pick-up site. The drum is first lifted and the filled liner is then removed from the dolly. After depositing the liner, the drum is returned to the dolly. The drum shape is preferably in the form of a truncated square pyramid, a truncated rectangular pyramid, or a truncated cone, and in several embodiments of the invention, the drum has raised ribs extending longitudinally on its exterior surface to prevent stacked drums from adhering together.

14 Claims, 6 Drawing Sheets

FIG. 1
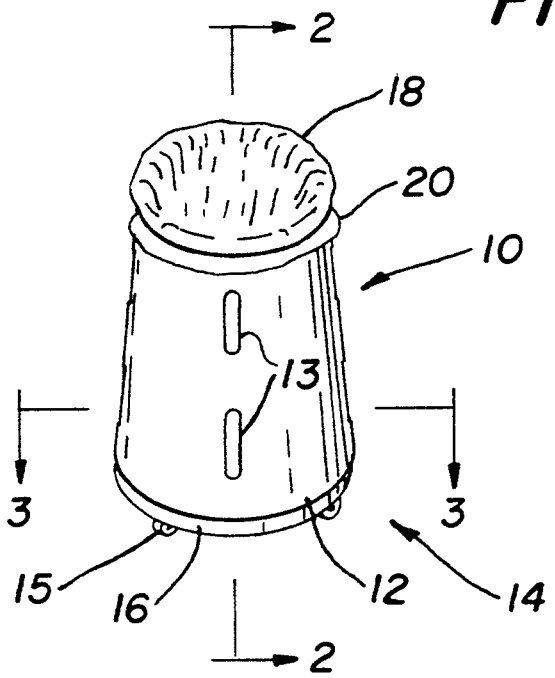
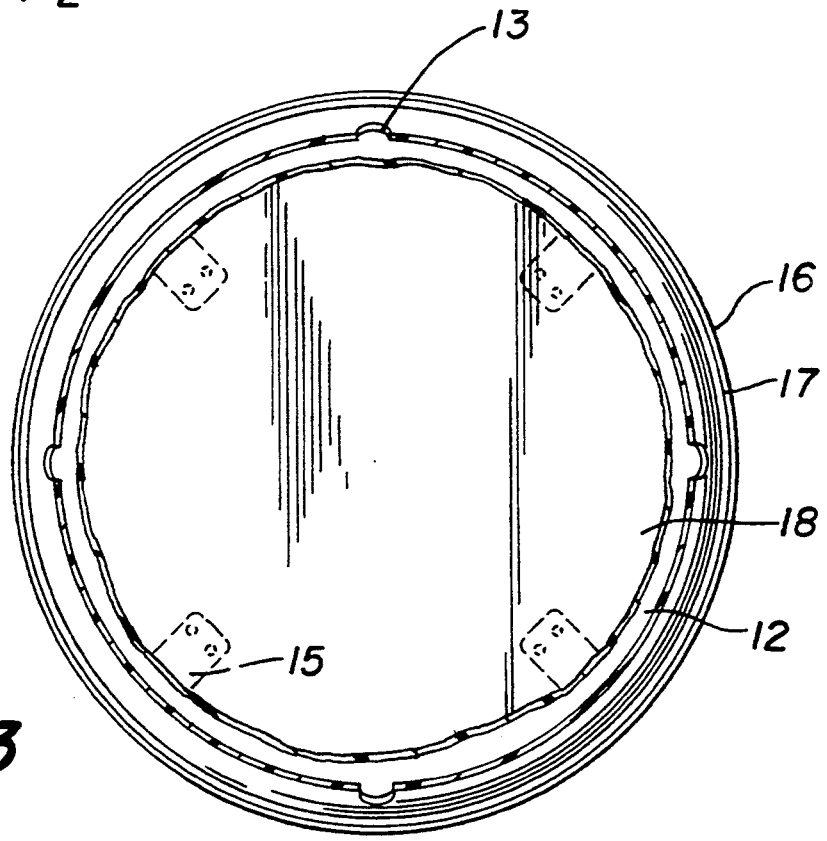
FIG. 3

FIG. 4
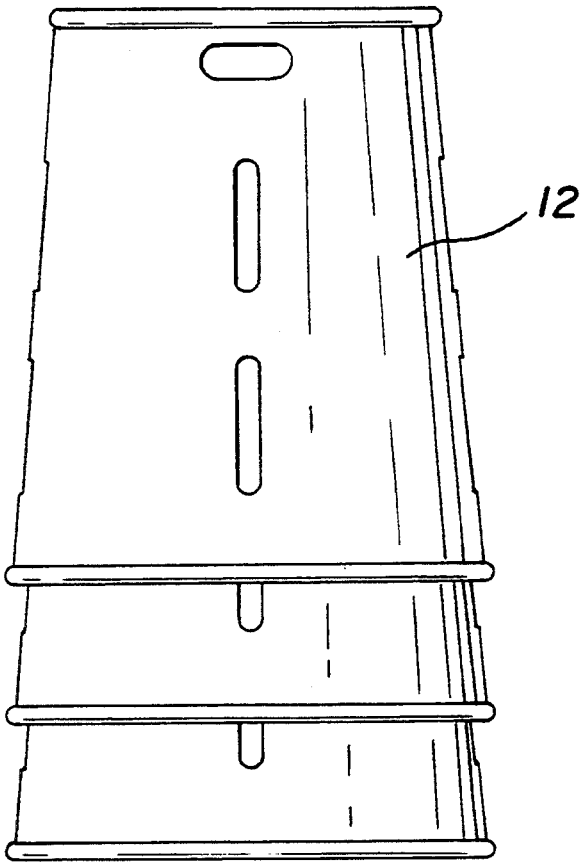
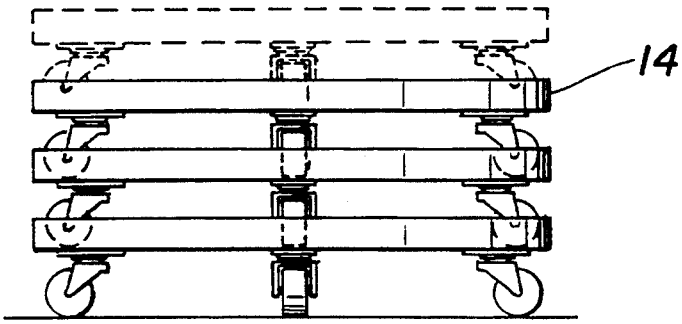
FIG. 5

FIG. 6
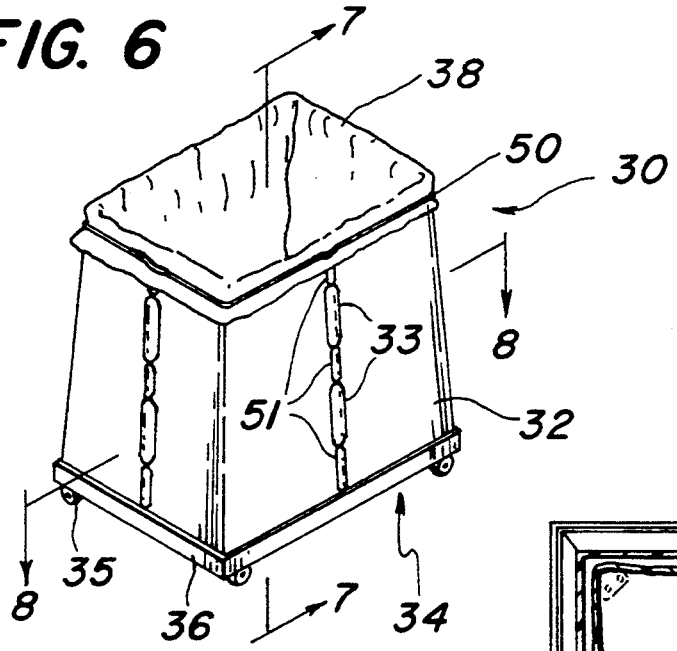
FIG. 8
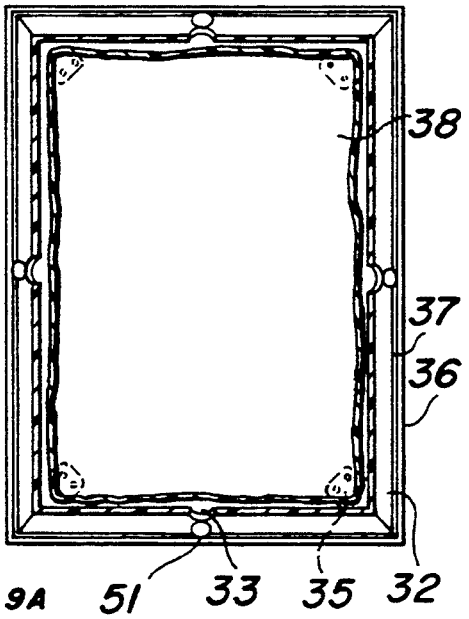
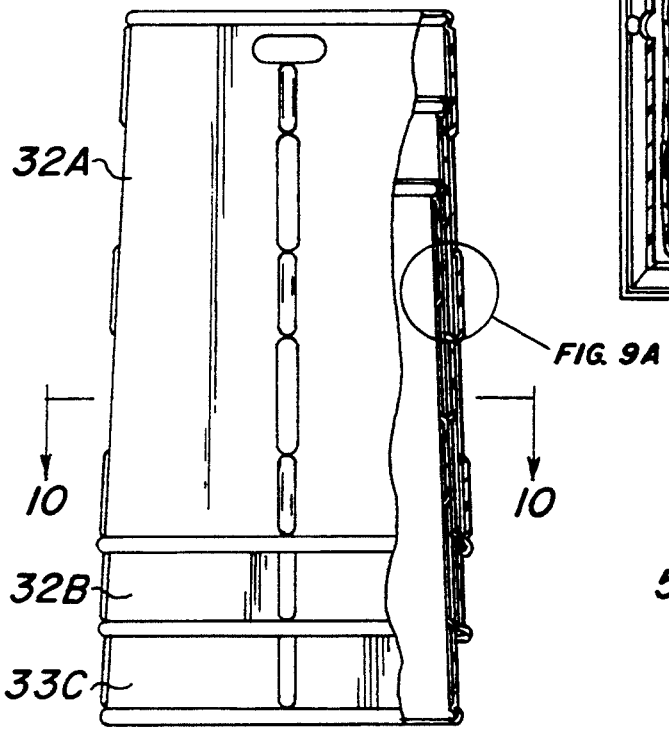
FIG. 9
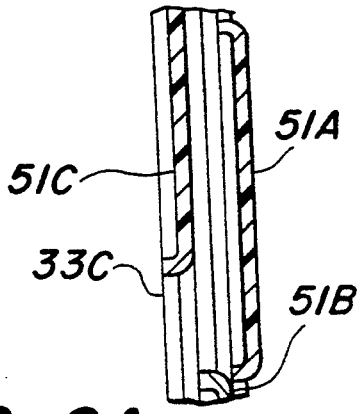
FIG. 9A

FIG. 10
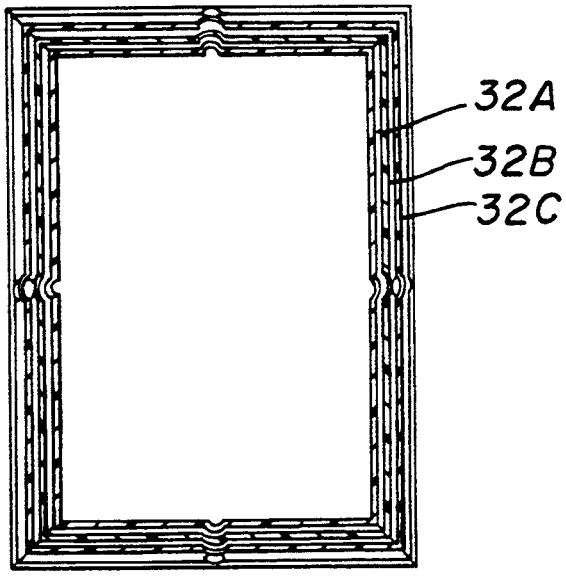
FIG. 11
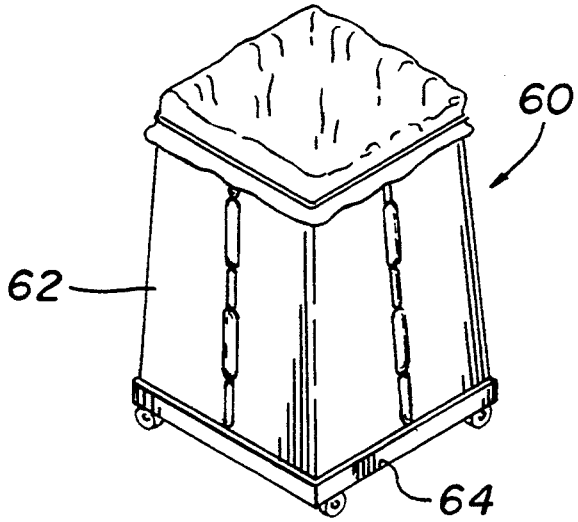
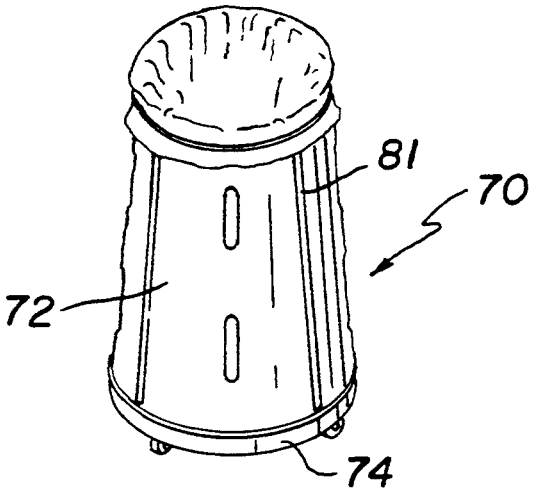
FIG. 12

TRASH CONTAINER

This application is a continuation-in-part of Ser. No. 08/038,825 filed Mar. 29, 1993 now U.S. Pat. No. 5,295,606.

BACKGROUND OF THE INVENTION

This invention relates, in general, to the field of trash collection and, in particular, relates to a container apparatus for receiving and disposing of trash.

It is sometimes the practice where large amounts of trash are produced, such as in areas where many people congregate, to position large receptacles in place. The receptacle in use on many occasions is a fifty-five gallon cylindrical steel or plastic drum. A large plastic bag is normally placed in the drum which receives the deposited trash and, when filled, the bag is removed for eventual placement in a dump site.

A recognized problem with this arrangement is that, when the plastic liner is filled and is ready for removal, the lifting aspect of the trash becomes onerous. The reason for this is that when the plastic liner bag becomes filled, its outside surface hugs the inside surface of the drum. In other words, the filled bag forces the air from between the metal drum and the plastic bag thereby creating a partial vacuum. The creation of the partial vacuum causes the removal of the liner to be difficult, thereby greater lifting force is required.

Another recognized problem with conventional cylindrical drums is the problem of storing of the empty cylindrical drums. The only way to stack cylindrical drums is one atop another, either lengthwise or on their sides, which requires a very large storage space.

It is therefore an object of the invention to provide a new and improved trash collection apparatus which solves these problems.

SUMMARY OF THE INVENTION

A trash container of the invention comprises a wheeled dolly which is adapted to receive a removable trash drum having a large bottom and small top opening. The drum includes vents for reasons that will become clear hereinbelow. The drum is dimensioned to receive a limp bag whose open end is removably attached or loosely positioned over a rim of the drum provided by its smaller opening.

When the bag is filled with trash or other disposable substances, it is secured at its open end by a tie, and is transferred via the dolly to a desired site for pick-up. At the pick-up site, the drum is removed thereby leaving the filled bag resting upon the dolly. The drum is easily separated from the bag due to the vented drum which eliminates a vacuum that might otherwise exist between the inside of the drum and the outside of the bag.

The bag is then removed from the dolly and left at the pick-up site after which the drum is returned to its original position. The dolly and drum are then returned to a desired location.

The apparatus of the invention can be used in another mode of operation where the dolly is not placed in use. In this mode, the drum is used in combination with the plastic liner where the drum is positioned in a location, for example, for collecting leaves or grass clippings. When leaves or grass clippings are being collected, the drum is positioned directly on the ground and the bag is placed within the drum as above-mentioned. In this application, the drum provides stability for the bag so that the leaves or grass clippings can be easily deposited.

The apparatus above-described includes other useful design features which are readily apparent when a plurality of such containers are being utilized as, for example, in large establishments such as hospitals, restaurants, factories and business complexes. Other locations where the invention may be used are fairgrounds and parks. When used in large institutional settings and large establishments, the design of the dolly and drum allows easy stacking of each on top of one another in a suitable location. Therefore, on the day where there is again a need for containers, the drums and dollies are taken to the desired locations where they are unstacked and re-assembled.

In one embodiment of the invention, the drum has a truncated cone shape.

In another embodiment of the invention, the drum has a truncated rectangular-pyramidal shape with a plurality of longitudinal ribs on the drum's exterior surface.

In yet another embodiment of the invention, the drum has a truncated square-pyramidal shape with a plurality of longitudinal ribs on the drum's exterior surface.

In still another embodiment of the invention, the drum has a truncated conical shape with a plurality of longitudinal ribs on the drum's exterior surface.

BRIEF DESCRIPTION OF THE DRAWINGS

FIG. 1 is a front elevational view of a truncated cone trash container of the present invention.

FIG. 3 is another sectional view of FIG. 1 taken along line 3—3.

FIG. 4 is a view of the invention illustrating stacking of the drum component of the container apparatus.

FIG. 5 is a view of the invention depicting a stacking of the dolly component of the container apparatus.

FIG. 6 is a front elevational view of a truncated rectangular pyramid trash container of the present invention.

FIG. 8 is another sectional view of FIG. 6 taken along line 8—8.

FIG. 9 is a partially cut-away sectional view of stacked truncated rectangular pyramid trash containers.

FIG. 9A is a close-up view of the cutaway portion of FIG. 9.

FIG. 10 is a sectional view of the stacked drums illustrated in FIG. 9 taken along line 10—10.

FIG. 11 is a front elevational view of a square pyramidal trash container of the present invention.

FIG. 12 is a front elevational view of a conical trash container having longitudinal ribs.

DESCRIPTION OF THE PREFERRED EMBODIMENT

Figure 2:
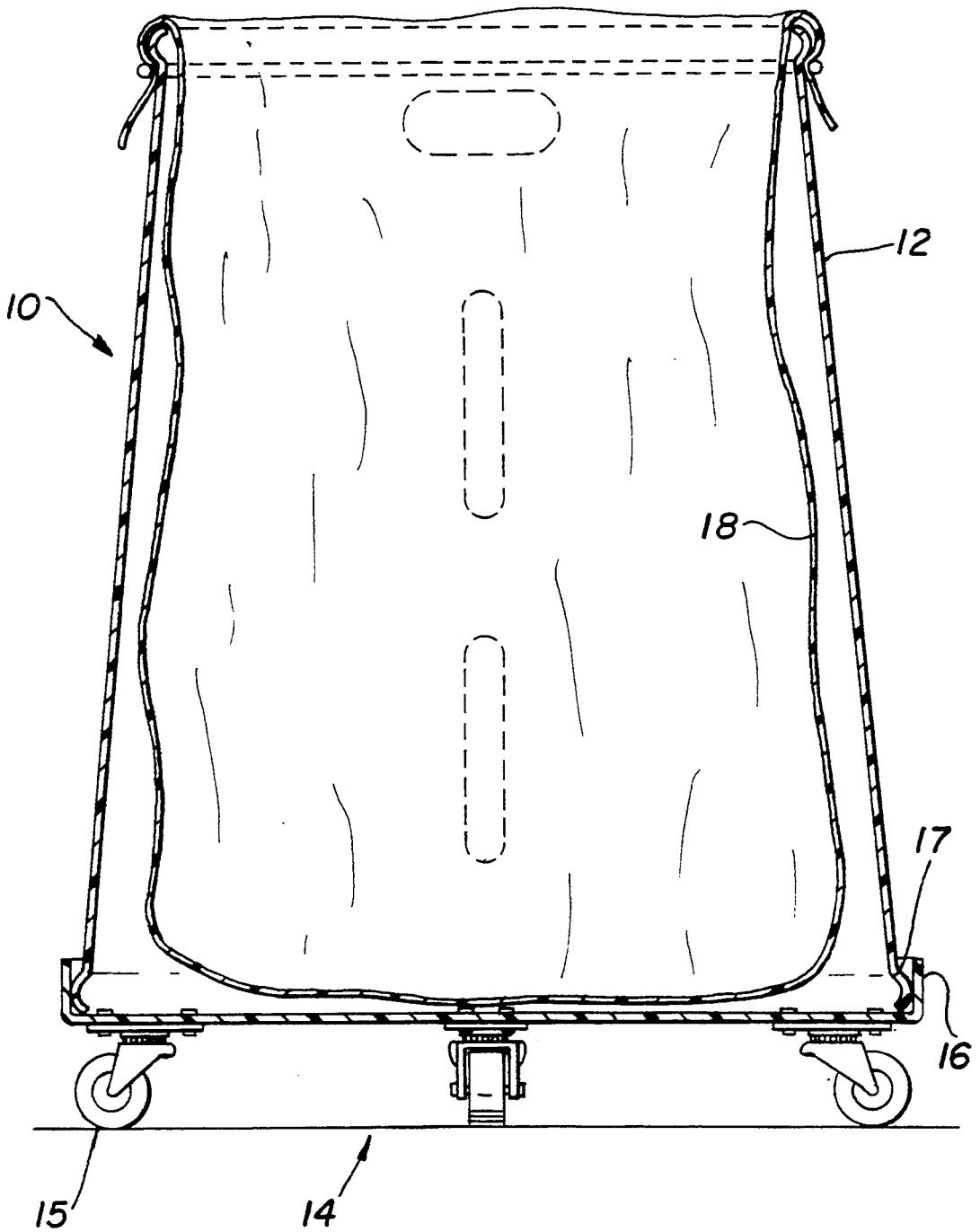
FIG. 2 is a sectional view of FIG. 1 taken along line 2—2.
Figure 7:
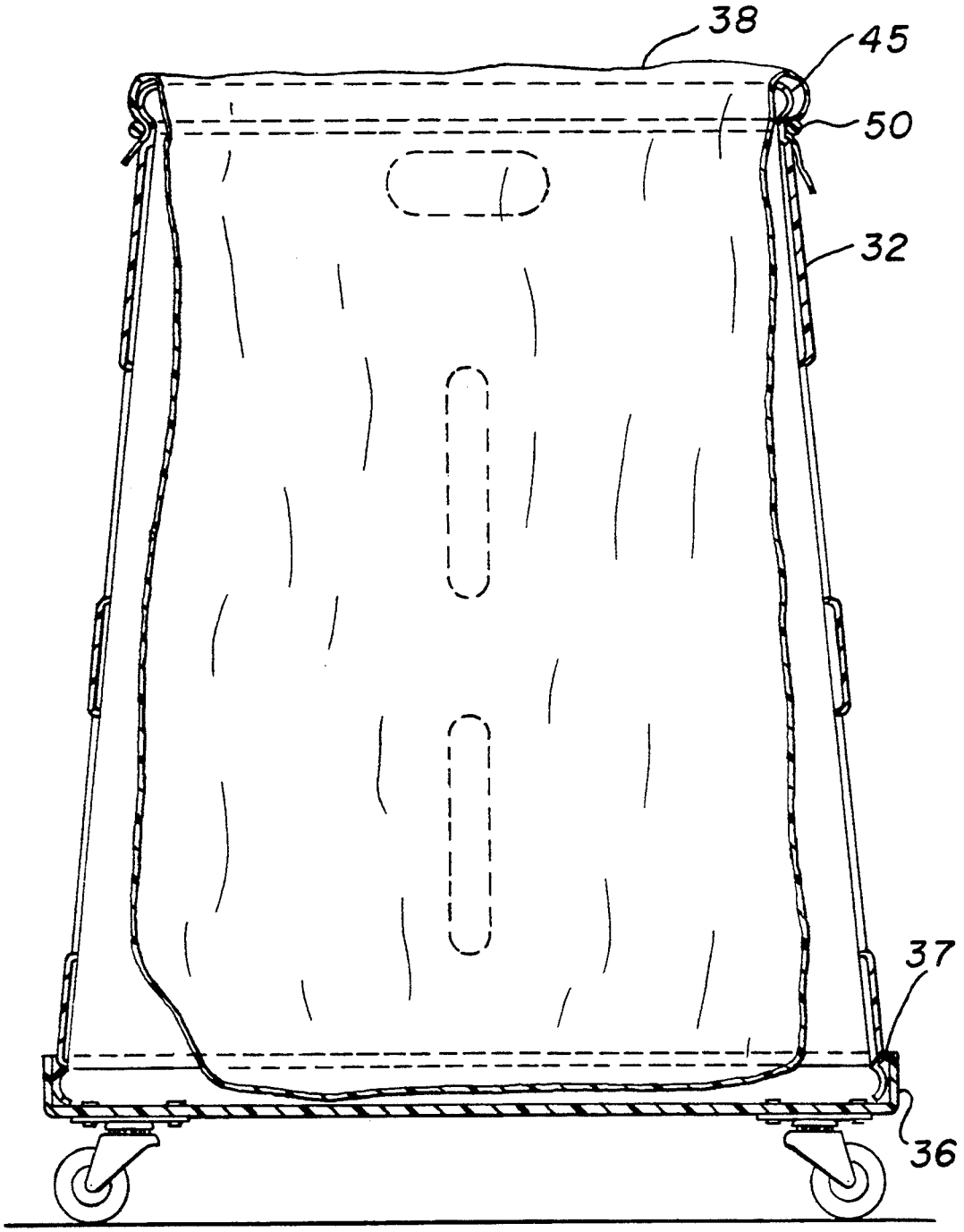
FIG. 7 is a sectional view of FIG. 6 taken along line 7—7.

Reference is now made to FIGS. 1 and 2 where the trash container assembly 10 of the invention is illustrated. The assembly 10 comprises a drum 12, which is shaped in a form of a truncated cone, and a circular dolly 14 upon which drum 12 is placed. The dolly 14 includes a lip 16 for properly receiving drum 12. Dolly 14 includes swivable wheels 15 located on its undersurface to facilitate movement of drum 12 to a site for pick-up or disposal as will become clear hereinafter. A plastic liner 18 is located within drum 12 for receiving trash and is held in place by a tie member 20, which may be an elastic, a flexible plastic or a string member. Tie member 20 is located under a ridge 25 which extends beyond the circumference of drum 12 and provides an optimum positioning location. The top of liner 18 is positioned over the top of drum 12, and tie 20 is wrapped around the inside surface of liner 18 to hold it securely in place.

Positioned along the sides of drum 12 from top to bottom are longitudinal slots 13. Slots 13 are employed to prevent a partial vacuum from being created between liner 18 and drum 12 when the latter is filled with trash; in other words, this filling action of liner 18 causes the outside surface of the liner to hug the inside surface of the drum 12 to thereby eliminate air from between the two items to create the partial vacuum. Therefore, slots 13 of drum 12 eliminate the vacuum; the wide base of drum 12 also eliminates friction between the plastic bag and the inner surface of the drum. The bottom of drum 12 provides a bulging rim or protrusion 17 which fits inside lip 16 on dolly 14. Protrusion 17 is dimensioned to provide a snug fit with lip 16 and to further provide for a stable assembly between drum 12 and dolly 14. Reference is made to the sectional view of FIG. 3 where the relationship of lip 16, protrusion 17, liner 18, slots 13, drum 12, and swivable wheels 15 with respect to one another are illustrated from a downwardly looking perspective.

The operation may be understood with greater clarity by referring again to FIG. 2. In an unassembled state, drum 12 is first positioned upon dolly 14 in a semi-permanent arrangement by placing protrusion 17 against lip 16 in an upright manner. Liner or bag 18 is located within drum 12 such that the bag's opening is placed over the top edge of drum 12 and downwardly. Tie member 20 is then located under ridge 25 and over bag 18 in order to maintain the latter in position within drum 12. When assembly 10 has been properly combined into a collection unit, it is positioned in a location which will be convenient to drop trash. As the initial trash is collected, it congregates in the bottom of bag 18 and expands until it contacts the sides of drum 12. As bag 18 is eventually filled, contact between it and drum 12 continues all the way from the bottom to the top.

The use of assembly 10 can be varied depending upon the intent of the user or owner. In the event that assembly 10 is owned by a homeowner, filled bag 18 may be rolled to a curb site from, for example, a garage. Tie member 20 is then removed and tile top of the bag is closed with a plastic tie wrap (not shown). Drum 12 is separated from assembly 10 which will occur easily, leaving the filled bag resting on dolly 14. Filled bag 18 is removed from dolly 14 and left at the curb site for pick-up; thereafter, drum 12 is re-placed upon dolly 14 and assembly 10 is rolled to its original location in the garage. An important feature of this invention is lip 16 on dolly 14. Bags 18 are often punctured by the trash disposed in them resulting in leaks from the bag. Lip 16 provides a containment basin to prevent liquid from escaping the dolly during use, thus, preventing unsanitary leakage of liquids onto the ground or the floor.

A portion of assembly 10 may be used in another mode of operation. As an example, assembly 10 may be used without dolly 14 for various chores where trash in the form of debris or leaves are required to be picked up. In this mode, drum 12 with the accompanied attached bag 18 is positioned at a location such as a homeowner's lawn where there is a need to pick up leaves or lawn clippings. Since this portion of assembly 10 is relatively light in weight, it may be readily moved by lifting from place-to-place where leaf or grass clippings are placed in piles. Again, bag 18 is filled with debris and, when filled, tie member 20 is removed so that a plastic tie wrap can be applied to enclose the bag's contents. As described above, drum 12 is separated from the enclosed bag for later pick-up.

Separated drum 12 is relocated to another site where other leaves or clippings are piled together for eventual bagging. The procedure above-described is repeated until all of the debris is collected and bagged. Upon completion of the collection task, all of the tied bags 18 are transported to a disposal site.

It should be understood, with respect to the above description, that when the contents of the bag allow it to be closely packed as, for example, with grass clippings, the outside surface of liner 18 particularly hugs the inside surface of conical drum 12. Due to the formation in the present invention of slots 13, no noticeable attaching effect is produced between bag 18 and drum 12 so that the latter may be readily removed from dolly 14.

Reference is now made to FIGS. 4 and 5 where drums 12 and dollies 14 are respectively shown in a stacked position. This is a feature of the invention represented by assembly 10 particularly where it is used in a park-like atmosphere, or where a great many people congregate in an area. Drums 12 of FIG. 4 are able to be stacked in view of their tapered shape; whereas, wheels 15 are positioned on the underside of dolly 14 so that they may be stacked by locating each within the circumference of the receiving dolly positioned immediately below.

The invention has here-to-for been described with reference to FIGS. 1–5 which illustrate one embodiment of the invention in which the shape of the drum is truncated conical.

Another embodiment of the invention is illustrated in FIGS. 6–10 in which assembly 30 comprises a drum shaped in the form of a truncated rectangular pyramid and a rectangular dolly 34 upon which drum 32 is placed. The dolly 34 includes a lip 36 for snugly receiving drum 32. Dolly 34 includes swivable wheels 35 located on its undersurface to facilitate movement of drum 32 to a site for pick-up or disposal. A plastic liner 38 is located within drum 32 for receiving trash and is held in place by a tie member 50 which may be an elastic, a flexible plastic, or string member. The tie member 50 is located under a ridge 45 which extends beyond the circumference of drum 32 and provides an optimum positioning location. The top of liner 38 is positioned over the top of drum 32 and tie 50 is wrapped around the inside surface of liner 18 to hold it securely in place. The feature may be viewed with greater clarity in FIG. 7.

Positioned along the sides of drum 32 from top to bottom are longitudinal slots 33 and longitudinal ribs 51. Slot 33 are employed to prevent a partial vacuum from being created between liner 38 and drum 32 when the latter is filled with trash. The bottom of drum 32 provides a bulging rim or protrusion 37 which fits inside lip 36 on dolly 34. Protrusion 37 is dimensioned to provide a snug fit with lip 36 and to further provide for a stable assembly between drum 32 and dolly 14. Reference is made to the sectional view of FIG. 8 where the relationship of lip 36, protrusion 37, liner 38, slots 33, ribs 51, drum 32, and swivable wheels 35 with respect to one another are illustrated in a downwardly looking perspective.

Ribs 51 are constructed to provide separation between stacked drums. Ribs 51 prevent adhesion between stacked drums particularly when drum surfaces are coated with sticky trash such as candy, spilled soda, etc. Thus, drums having ribs are more easily detached from each other during unstacking than are drums without ribs. FIGS. 9 and 9A illustrate stacked drums 32A, 32B, and 32C having ribs 51A, 51B, and 51C, respectively. FIG. 10 illustrates a sectional view of the stacked drums 32A, 32B, and 32C.

Assembly 30 is utilized as described herein for assembly 10 but with assembly 30 having the aforesaid improvement of a ribbed drum.

Two other embodiments of this invention are illustrated in FIGS. 11 and 12. FIG. 11 illustrates assembly 60 which comprises a drum 62 which is shaped in the form of a truncated square pyramid and a square dolly 64 upon which drum 62 is placed. The features of drum 62 are essentially the same as described for assembly 30 with assemblies 30 and 60 differing only in their respective drum and dolly shapes.

FIG. 12 illustrates assembly 70 which comprises a drum 72 which is shaped in the form of a truncated cone and a circular dolly 74 upon which drum 72 is placed. Drum 72 has longitudinal ribs 81 which extend along the length of drum 72 to provide separation between drums when they are stacked one atop another as before described. Assembly 70 is utilized as described earlier for assembly 10 but with assembly 70 having the aforesaid improvement of a ribbed drum.

The ribs described for the invention herein may be located either in alignment with drum slots as shown in FIGS. 6–11 or may be located out of alignment with drum slots as shown in FIG. 12, so long as the ribs extend longitudinally along drum exterior surfaces to provide separation between the drums during stacking and to thereby facilitate detachment of drums from each other during unstacking.

In summary, a novel trash container has been described and illustrated which facilitates the accumulation of trash. In one mode, the trash container assembly permits trash to be collected in a liner and afterwards transferred by a dolly to a site for pick-up. In this mode, the dolly with a lip provides a catch basin for containing leakage and spills from damaged liners. In a second mode, a portion of the assembly may be utilized to allow for easy pick-up of debris but without use of the dolly. The trash container assembly is also designed for facile stacking and unstacking when there are a plurality of such units at a location where large numbers of people congregate such as a park, recreation, church, or playground area.

This invention has been described by reference to precise embodiments, but it will be appreciated by those skilled in the art that this invention is subject to various modifications and to the extent that those modifications would be obvious to one of ordinary skill they are considered as being within the scope of the appended claims.

What is claimed is:

1. A two-unit trash container apparatus comprising,
   a. a movable means;
   b. a rigid drum means having an interior surface and an exterior surface and having a small and a large opening wherein the larger opening is adapted to be positioned upon said movable means;
   c. means circumferentially surrounding said movable means and rigid drum means positioned to provide a snug fitting arrangement for semi-permanent attachment to one another,
   d. said circumferential surrounding means of said movable means also being dimensioned to locate additional movable means when a plurality are stacked one above another;
   e. means located at approximately each quadrant of said rigid drum for providing air passages to allow atmospheric pressure to penetrate;
   f. means having an entrance positioned within said drum means and upon said movable means for receiving disposable matter, and said air passages eliminating a partial vacuum that is created between said rigid drum means and said receiving means when filled with disposable matter, and
   g. said circumferential surrounding means acting as a basin for retaining spillage in the event that said receiving means is damaged,
   h. means for semi-permanently attaching said receiving means to said drum means,
   i. whereby when said receiving means is filled and said attaching means is removed, said two-unit container may be transferred to a site by said movable means where said drum means is easily separated by the elimination of said partial vacuum and by operation of said snug fitting, such that said receiving means may be lifted from said movable means for discarding purposes.

2. A trash container apparatus in accordance with claim 1 wherein said movable means comprises a cart.

3. A trash container apparatus in accordance with claim 2 wherein said cart includes attached wheels, said wheels being located immediately inside said surrounding means for proper stacking of a plurality of said carts one above the other.

4. A trash container apparatus in accordance with claim 1 wherein said means circumferentially surrounding said movable means comprises,
   a raised lip, and
   said drum means in a mated state with said movable means being located within said lip.

5. A trash container apparatus in accordance with claim 4 and further comprising,
   a. a protrusion surrounding the circumference of the bottom of said drum means to provide said snug fitting arrangement when said drum means is mated with said raised lip circumferentially surrounding said movable means, and
   b. said raised lip further acting as a basin to retain any spillage resulting from damage to said means for receiving disposed matter.

6. A trash container apparatus in accordance with claim 1 and further comprising,
   a protrusion extending around the circumference of the small drum opening.

7. A trash container apparatus in accordance with claim 6 wherein said receiving means comprises, a flexible bag for placement in said drum means, and wherein a circumference of said bag's opening is extended over said small drum opening and over said protrusion.

8. A trash container apparatus in accordance with claim 7 and further including, a tie means for fitting over said protrusion and extending around said small drum opening for attaching said flexible bag to said drum means.

9. A trash container apparatus in accordance with claim 8 wherein said tie means is elastic.

10. A trash container apparatus in accordance with claim 2 wherein said drum has a shape of a truncated cone, wherein said drum has a plurality of ribs extending longitudinally along said drum exterior surface, and wherein said cart has a circular shape.

11. A trash container apparatus in accordance with claim 2 wherein said drum has a shape of a truncated rectangular pyramid, and wherein said cart has a rectangular shape.

12. A trash container apparatus in accordance with claim 11 wherein said drum has a plurality of ribs extending longitudinally along said drum exterior surface.

13. A trash container in accordance with claim 2 wherein said drum has a shape of a truncated square pyramid, and wherein said cart has a square shape.

14. A trash container in accordance with claim 13 wherein said drum has a plurality of ribs extending longitudinally along said drum exterior surface.

* * * * *